US006389952B1

(12) United States Patent
Riddick et al.

(10) Patent No.: US 6,389,952 B1
(45) Date of Patent: May 21, 2002

(54) APPARATUS AND METHOD OF OPERATING A FLUID CYLINDER OF A WORK MACHINE

(75) Inventors: Melinda A. Riddick, Aurora; Raj Velji, Hanover Park, both of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/322,652

(22) Filed: May 28, 1999

(51) Int. Cl.[7] ..... F15B 11/08
(52) U.S. Cl. ..... 91/437; 60/494
(58) Field of Search ..... 91/437, 450, 464; 60/468, 494

(56) References Cited

U.S. PATENT DOCUMENTS 3,759,564 A * 9/1973 Seaberg ..... 294/88
5,307,631 A * 5/1994 Tatsumi et al. ..... 60/452
5,331,882 A * 7/1994 Miller ..... 91/461
5,727,610 A 3/1998 Isley ..... 144/4.1

OTHER PUBLICATIONS

Catalog from Caterpillar entitled, "Forest Pro" vol. 1 No. 1 copyright 1998.

* cited by examiner

*Primary Examiner*—Edward K. Look
*Assistant Examiner*—Thomas E. Lazo
(74) *Attorney, Agent, or Firm*—Maginot, Addison & Moore

(57) ABSTRACT

A work machine is disclosed. The work machine includes a work implement and a fluid cylinder mechanically coupled to the work implement. The fluid cylinder is controlled by an apparatus that automatically places the fluid cylinder in a float mode of operation when a control valve fluidly coupled to the fluid cylinder is placed in a neutral position.

13 Claims, 2 Drawing Sheets

APPARATUS AND METHOD OF OPERATING A FLUID CYLINDER OF A WORK MACHINE

TECHNICAL OF THE INVENTION

The present invention relates generally to a fluid cylinder, and more particularly to an apparatus and method of operating a fluid cylinder of a work machine.

BACKGROUND OF THE INVENTION

Work machines, such as log loaders, typically include a tilt cylinder (i.e. a fluid cylinder) having a rod and a housing. The rod and housing of the tilt cylinder are respectively attached to a work implement and a stick of the work machine. The tilt cylinder operates to rotate or tilt the work implement relative to the stick during the performance of a work function. For example, an operator of a log loader will typically have to actuate the tilt cylinder so as to rotate the work implement relative to the stick before "grasping" logs with the work implement.

After grasping the logs with the work implement it is desirable to place the tilt cylinder in what is commonly known as the "float mode". Once in the float mode the rod of the tilt cylinder is substantially free to move inwardly and outwardly relative to the housing. Having the rod being able to freely move inwardly and outwardly relative to the housing allows the work implement to freely rotate or swing relative to the stick when loaded. Allowing the work implement to freely swing when loaded reduces the wear and tear on the work machine, and in particular reduces the wear and tear on a rotate motor of the work machine. Moreover, having the tilt cylinder in the float mode of operation when the work implement is grasping a number of logs facilitates the loading of the logs onto a platform, such as a truck bed.

Heretofore, to place the tilt cylinder in and out of the float mode of operation, a switch located in the cab assembly of the work machine had to be manually actuated by the operator. Manually actuating the switch is inconvenient for the operator. As a result, some operators tend to neglect placing the tilt cylinder in the float mode of operation when the work implement is loaded (i.e. grasping logs). As previously mentioned, not placing the tilt cylinder in the float mode of operation increases the wear and tear on the work machine, thereby increasing the maintenance cost thereof.

What is needed therefore is an apparatus and method of operating a fluid cylinder of a work machine which overcomes one or more of the above-mentioned drawbacks.

DISCLOSURE OF THE INVENTION

In accordance with a first embodiment of the present invention, there is provided an apparatus for operating a fluid cylinder of a work machine. The fluid cylinder (i) has a rod and a housing and (ii) is operable in (1) an extend mode in which the rod is urged outwardly from the housing by fluid being advanced by an operational pressure source and (2) a retract mode in which the rod is urged inwardly into the housing by fluid being advanced by the operational pressure source. The apparatus includes a cylinder actuator operatively coupled to the fluid cylinder. The cylinder actuator is positionable between (i) an extend position in which the fluid cylinder is placed in the extend mode, (ii) a retract position in which the fluid cylinder is placed in the retract mode, and (iii) an isolate position in which the fluid cylinder is isolated from the operational pressure source. The apparatus also includes a sensing arrangement operatively coupled to the cylinder actuator and the fluid cylinder so that (i) the sensing arrangement detects when the cylinder actuator is in the isolate position and (ii) the sensing arrangement generates a signal in response to detecting that the cylinder actuator is in the isolate position so as to cause the fluid cylinder to be placed in a float mode of operation in which the rod is substantially free to move outwardly from the housing or move inwardly into the housing.

In accordance with a second embodiment of the present invention, there is provided a work machine. The work machine includes a work implement and a fluid cylinder mechanically coupled to the work implement. The fluid cylinder (i) has a rod and a housing and (ii) is operable in (1) an extend mode in which the rod is urged outwardly from the housing and (2) a retract mode in which the rod is urged inwardly into the housing. The work machine also includes an operational pressure source for advancing a fluid so as to cause the rod to be urged outwardly or inwardly relative to the housing. The work machine further includes a control valve (i) positionable between an extend position, a retract position, and a neutral position, and (ii) fluidly coupled with the operational pressure source and the fluid cylinder so that when the control valve is (1) in the extend position the fluid cylinder is in the extend mode, (2) in the retract position the fluid cylinder is in the retract mode, and (3) in the neutral mode the fluid cylinder is isolated from the operational pressure source. The work machine also includes a float valve fluidly coupled to the fluid cylinder. The float valve being positionable between (i) an open position in which fluid from the fluid cylinder can be advanced through the float valve and (ii) a closed position in which fluid from the fluid cylinder can not be advanced through the float valve. The work machine also includes a sensing arrangement (i) coupled to the control valve and the float valve and (ii) operable so as to cause the float valve to be (1) positioned in the open position in response to detecting that the control valve is positioned in the neutral position and (2) positioned in the closed position in response to detecting that the control valve is positioned in the extend position or the retract position.

In accordance with a third embodiment of the present invention there is provided a method of operating a fluid cylinder which is operatively coupled to a cylinder actuator, wherein (i) the fluid cylinder has a housing and a rod positioned within the housing and (ii) the cylinder actuator is positionable between (1) an extend position in which the rod is urged outwardly from the housing by fluid being advanced by an operational pressure source, (2) a retract position in which the rod is urged inwardly into the housing by fluid being advanced by the operational pressure source, and (3) an isolate position in which the fluid cylinder is isolated from the operational pressure source. The method includes the steps of (i) detecting when the cylinder actuator is in the isolate position with a sensor and (ii) placing the fluid cylinder in a float mode of operation in which the rod is substantially free to move outwardly from the housing or move inwardly into the housing in response to detecting with the sensor that the cylinder actuator is in the isolate position.

BEST MODE FOR CARRYING OUT THE INVENTION

Figure 1:
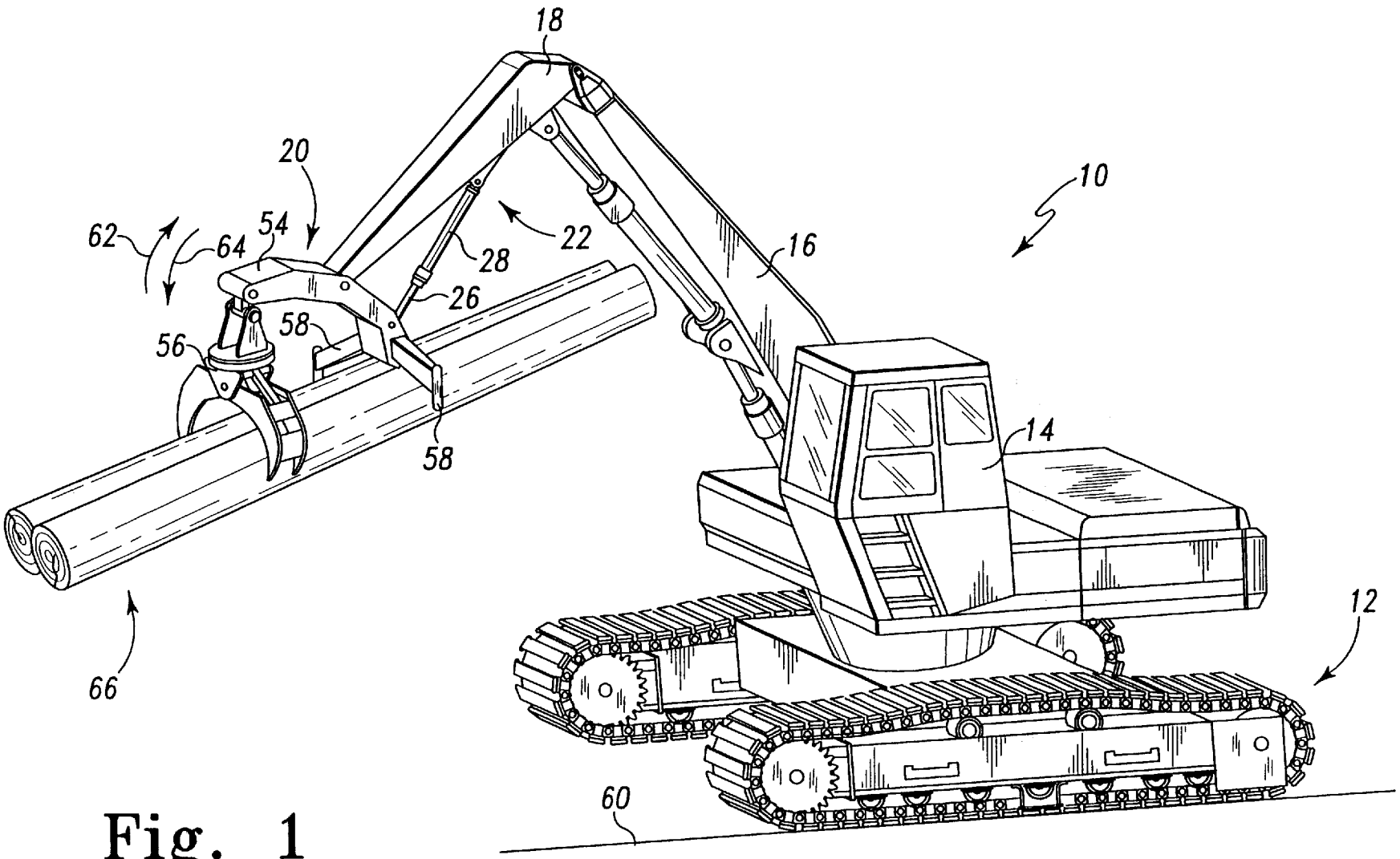
FIG. 1 is a side elevational view of an exemplary work machine which incorporates the features of the present invention therein.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown an exemplary work machine 10 which incorporates the features of the present invention therein. In particular, work machine 10 is a log loader. Work machine 10 includes a track assembly 12 for advancing work machine 10 over a ground segment 60. Work machine 10 also includes a cab assembly 14 and a boom 16 supported by track assembly 12. A stick 18 is pivotally attached to boom 16. Work machine 10 also includes a work implement 20 and a fluid cylinder 22. Work machine 10 further includes an apparatus 24 (see FIG. 2) for operating fluid cylinder 22.

Work implement 20 includes a head 54 pivotally attached to an end of stick 18. In addition, work implement 20 includes a grapple 56 secured to one end of head 54 and a pair of outriggers 58 extending from the other end of head 54.

Figure 2:
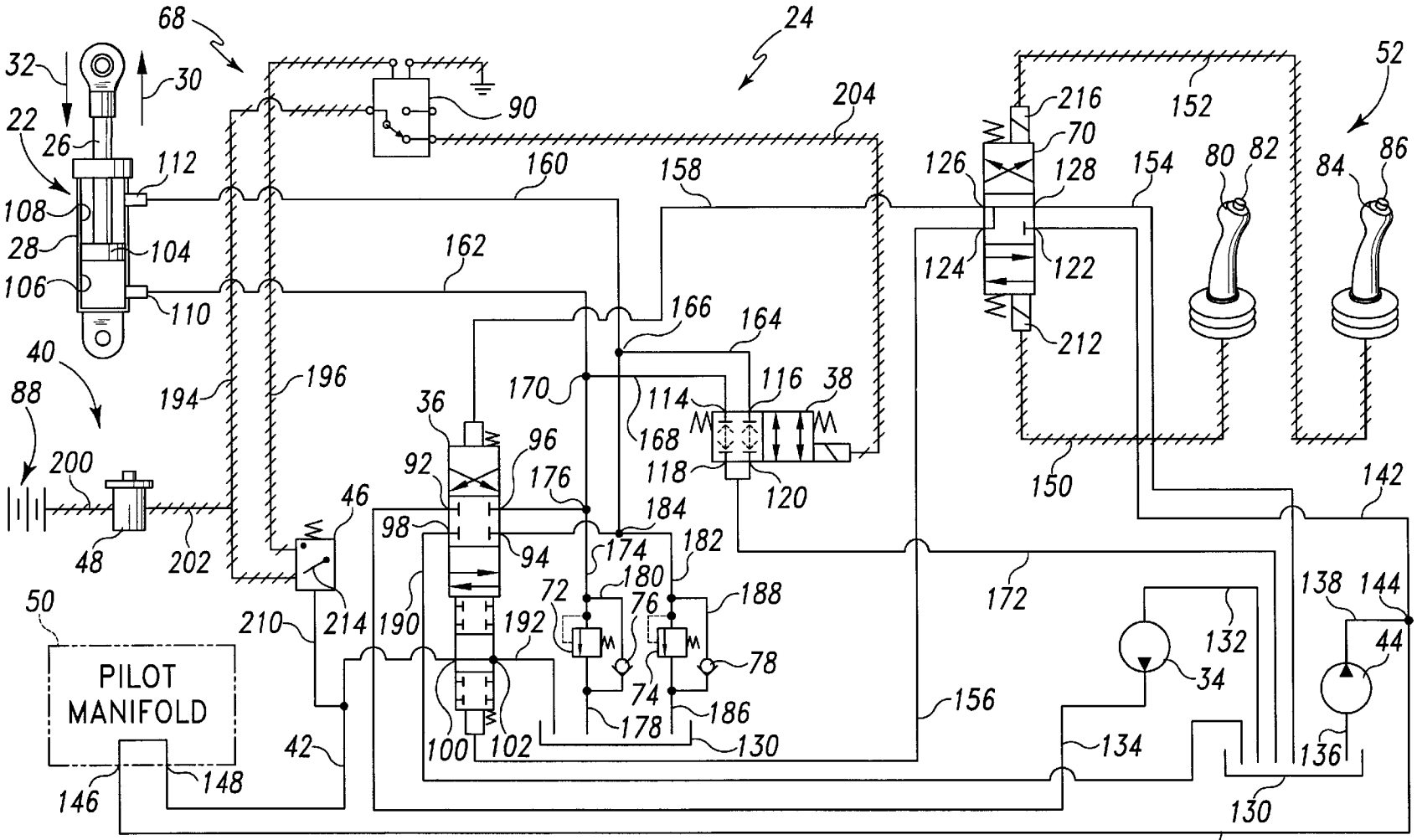
FIG. 2 is a schematic view of an apparatus for controlling a fluid cylinder of the work machine of FIG. 1.

Fluid cylinder 22 includes a housing 28 and a rod 26 positioned within housing 28. Rod 26 is secured to head 54 of work implement 20. Housing 28 is secured to stick 18. As shown in FIG. 2, rod 26 is secured to a piston 104 which is located within housing 28. Piston 104 divides housing 28 into a piston chamber 106 and a rod chamber 108. Fluid cylinder 22 is operable in (i) an extend mode in which fluid advanced by an operational pressure source 34 urges rod 26 outwardly from housing 28 in the direction indicated by arrow 30 and (ii) a retract mode in which fluid advanced by operational pressure source 34 urges rod 26 inwardly into housing 28 in the direction indicated by arrow 32.

As shown in FIG. 1, it should be understood that placing fluid cylinder 22 in the extend mode causes work implement 20 to move or rotate relative to stick 18 in the direction indicated by arrow 62. Moreover, placing fluid cylinder 22 in the retract mode causes work implement 20 to move or rotate relative to stick 18 in the direction indicated by arrow 64.

Fluid cylinder 22 is also operable in a float mode of operation in which fluid cylinder 22 is isolated from operational pressure source 34. In other words, when fluid cylinder 22 is placed in the float mode, operational pressure source 34 is prevented from advancing fluid so as to urge rod 26 outwardly or inwardly relative to housing 28. It should be appreciated that when fluid cylinder 22 is in the float mode, rod 26 of fluid cylinder 22 is substantially free to move relative to housing 28 in both of the aforementioned directions. In particular, when fluid cylinder 22 is in the float mode rod 26 is substantially free to (i) move outwardly from housing 28 in the direction indicated by arrow 30 or (ii) move inwardly into housing 28 in the direction indicated by arrow 32.

Therefore, it should be understood that when fluid cylinder 22 is placed in the float mode work implement 20 is able to freely swing back and forth relative to stick 18 in the directions indicated by arrows 62 and 64 (see FIG. 1). In particular, when fluid cylinder 22 is placed in the float mode and work implement 20 is loaded with a number of logs 66, as shown in FIG. 1, work implement 20 and logs 66 can swing back and forth relative to stick 18 in the directions indicated by arrows 62 and 64 until work implement 20 and logs 66 reach an equilibrium orientation relative to stick 18. This is in contrast to when fluid cylinder 22 is in the above discussed extend mode or retract mode in which the work implement 20 would not be able to freely swing back and forth in the above described manner.

Referring now to FIG. 2, apparatus 24 includes operational pressure source 34, a control valve 36, a float valve 38, drain valves 72 and 74, and check valves 76 and 78. Apparatus 24 also includes spool valve 70, a work implement actuator 52, and a sensing arrangement 40.

Control valve 36 has pressure ports 92, 94, and 96 defined therein. Control valve 36 also has a drain port 98 defined therein. In addition, control valve 36 has a pair of pilot ports 100 and 102 defined therein. Moreover, control valve 36 is positionable between (i) an extend position, (ii) a retract position, and (iii) a neutral position.

Float valve 38 has float ports 114, 116, 118, and 120 defined therein. In addition, float valve 38 is positionable between (i) an open position in which fluid from fluid cylinder 22 can be advanced through float valve 38 and (ii) a closed position in which fluid from fluid cylinder 22 can not be advanced through float valve 38.

Spool valve 70 has a pump port 122, a valve port 124, a valve port 126, and a tank port 128 defined therein. Furthermore, spool valve 70 is positionable between (i) a rest position, (ii) a first spool position, and (iii) a second spool position.

Work implement actuator 52 includes a joystick 80 having a button 82 extending therefrom. Work implement actuator 52 also includes a joystick 84 having a button 86 extending therefrom. Buttons 82 and 86 are positionable between a depressed position and a non-depressed position. Work implement actuator 52 is positionable between (i) a float position, (ii) a first tilt position, and (iii) a second tilt position. In particular, when buttons 82 and 86 are both in the non-depressed position work implement actuator 52 is in the float position. When button 82 is in the depressed position and button 86 is in the non-depressed position work implement actuator 52 is in the first tilt position. When button 86 is in the depressed position and button 82 is in the non-depressed position work implement actuator 52 is in the second tilt position.

Sensing arrangement 40 includes a pilot pressure source 44, a pilot manifold 50, and a control circuit 68. Control circuit 68 includes a power source 88 and an actuation switch 48 positionable between an actuated position and a deactuated position. Control circuit 68 also includes a pressure sensor 46 and a float relay 90. Pressure sensor 46 is positionable between an on position and an off position. Float relay 90 is positionable between an open position and a closed position.

Operational pressure source 34 is in fluid communication with a tank 130 via a fluid line 132. In addition, operational pressure source 34 is coupled to pressure port 92 of control valve 36 via a fluid line 134. Pilot pressure source 44 is in fluid communication with tank 130 via a fluid line 136. Pilot pressure source 44 is also coupled to fluid line 138 which is coupled to fluid lines 140 and 142 via junction 144. Fluid line 142 is coupled to pump port 122 of spool valve 70. Fluid line 140 is coupled to an entrance port 146 of pilot manifold 50. Pilot manifold 50 places fluid line 140 in fluid communication with a pilot line 42 which has one end coupled to an exit port 148 of pilot manifold 50. The other end of pilot line 42 is coupled to pilot port 100 of control valve 36. Drain port 98 of control valve 36 is coupled to a drain line 190 which leads to tank 130. Furthermore, pilot port 102 of control valve 36 is coupled to a drain line 192 which leads to tank 130.

Spool valve 70 is electrically coupled to button 82 via electrical line 150. In a similar manner, spool valve 70 is also electrically coupled to button 86 via electrical line 152. A fluid line 154 places tank port 128 of spool valve 70 in fluid communication with tank 130. Valve port 124 of spool valve 70 is coupled to control valve 36 via fluid line 156. In a similar manner, valve port 126 is coupled to control valve 36 via a fluid line 158.

A rod port 112 of fluid cylinder 22 is coupled to pressure port 94 of control valve 36 via a fluid line 160. In a similar manner, a piston port 110 of fluid cylinder 22 is coupled to pressure port 96 of control valve 36 via a fluid line.

One end of a fluid line 164 is coupled to float port 116 of float valve 38. The other end of fluid line 164 is coupled to fluid line 160 via a junction 166. Similarly, one end of a fluid line 168 is coupled to float port 114 of float valve 38. The other end of fluid line 168 is coupled to fluid line 162 via a junction 170. Fluid ports 118 and 120 of float valve 38 are both coupled to a fluid line 172 which leads back to tank 130.

Drain valve 72 is coupled to fluid line 162 via a fluid line 174 and a junction 176. Drain valve 72 is also in fluid communication with tank 130 via a fluid line 178. Check valve 76 is coupled to fluid lines 174 and 178 via a fluid line 180.

Drain valve 74 is coupled to fluid line 160 via a fluid line 182 and a junction 184. Drain valve 74 is also in fluid communication with tank 130 via a fluid line 186. Check valve 78 is coupled to fluid lines 182 and 186 via a fluid line 188.

Pressure sensor 46 is electrically coupled to float relay 90 via electrical lines 194 and 196. Float relay 90 is electrically coupled to float valve 38 via electrical line 204. Pressure sensor 46 is also coupled to pilot line 42 via a sensor line 210.

Power source 88 is electrically coupled to actuator switch 48 via an electrical line 200. Actuator switch 48 is electrically coupled to electrical line 194 via an electrical line 202.

Industrial Applicability

During use of work machine 10, actuation switch 48 can be placed in the actuated position or the deactuated position. Typically, during the use of work machine 10 actuation switch 48 will be positioned in the actuated position. When actuation switch 48 is located in the actuated position, current is applied from power source 88 to pressure sensor 46 so as to place pressure sensor 46 in the on position. Moreover, when actuation switch 48 is located in the actuated position, current is applied from power source 88 to float relay 90 via electrical lines 200, 202, and 194. Applying current to float relay 90 via electrical line 194 causes float relay 90 to be located in the closed position as shown in FIG. 2. When float relay 90 is in the closed position, current is applied to a solenoid associated with float valve 38 via electrical line 204. Applying current to float valve 38 in the above described manner causes float valve 38 to be maintained in the open position.

It should be appreciated that during use of work machine 10 work implement actuator 52 is normally maintained in the float position (i.e. neither button 82 or 86 is depressed). Having work implement actuator 52 in the float position maintains spool valve 70 in the rest position. Having spool valve 70 in the rest position prevents fluid from being advanced from pilot pressure source 44 though pump port 122 via fluid line 142. Preventing fluid from being advanced through pump port 122 of spool valve 70 maintains control valve 36 in the neutral position.

When control valve 36 is in the neutral position, fluid pumped from tank 130 by pilot pressure source 44 (via fluid line 136) is allowed to flow from pilot pressure source 44 through fluid lines 138 and 140. The fluid then flows through pilot manifold 50 into pilot line 42. Once in pilot line 42, the fluid is allowed to flow through control valve 36, via pilot ports 100 and 102, and then to drain line 192. Drain line 192 then directs the fluid to tank 130.

It should be understood that allowing fluid to freely flow through control valve 36 to tank 130 in the above described manner maintains the pressure in pilot line 42 relatively low. Furthermore, allowing the fluid to freely flow through control valve 36 in the above described manner maintains the pressure in sensor line 210 relatively low since sensor line 210 is coupled to pilot line 42. In particular, when control valve 38 is in the neutral position, and fluid is allowed to flow in the above described manner, the pressure in sensor line 210 is maintained below a predetermined threshold of pressure sensor 46. It should be appreciated that as long as the pressure in sensor line 210 remains below the predetermined threshold of pressure sensor 46, current is continuously applied to the solenoid associated with float valve 38 so as to maintain float valve 38 in the open position.

It should also be understood that having control valve 36 in the above described neutral position isolates fluid cylinder 22 from operational pressure source 34 (i.e. operational pressure source 34 is prevented from advancing fluid into housing 28 of fluid cylinder 22 via rod port 112 or piston port 110). In other words when control valve 36 is in the neutral position, fluid is prevented from being advanced through pressure port 92 of control valve 36 via fluid line 134.

Having float valve 38 in the open position and fluid cylinder 22 isolated from operational pressure source 34 places fluid cylinder 22 in the float mode of operation. As previously discussed, when fluid cylinder 22 is in the float mode of operation rod 26 is substantially free to (i) move outwardly from housing 28 in the direction indicated by arrow 30 or (ii) move inwardly into housing 28 in the direction indicated by arrow 32. For example, when fluid cylinder 22 is in the float mode of operation and rod 26 is moved relative to housing 28 in the direction indicated by arrow 30 (e.g. the weigh of logs 66 grasped by grapple 56 of work implement 20 causes rod 26 to move in the above described manner), the fluid contained within rod chamber 108 is forced out of housing 28 via rod port 112. Once through rod port 112 the fluid is advanced through fluid lines 160 and 164. The fluid is then advanced through float valve 38 via float ports 116 and 120. After passing through float valve 38, the fluid is directed to tank 130 via fluid line 172. Note that when fluid cylinder 22 is in the float mode the fluid is not advanced to tank 130 via drain valve 74 because the pressure of the fluid advancing through fluid line 160 is not great enough to overcome the pressure threshold of drain valve 74.

As fluid is being advanced out of rod chamber 108 in the above described manner, fluid is simultaneously being advanced into piston chamber 106. In particular, fluid is advanced from tank 130 into fluid line 178, through check valve 76, and into fluid line 162 via fluid line 180. Once in fluid line 162, the fluid is advanced into piston chamber 106 via piston port 110.

In the alternative, when fluid cylinder 22 is in the float mode of operation and rod 26 is moved relative to housing 28 in the direction indicated by arrow 32, the fluid contained within piston chamber 106 is forced out of housing 28 via piston port 110. Once through piston port 110 the fluid is advanced through fluid lines 162 and 168. The fluid is then advanced through float valve 38 via float ports 114 and 118. After passing through float valve 38, the fluid is directed to tank 130 via fluid line 172. Note that when fluid cylinder 22 is in the float mode the fluid is not advanced to tank 130 via drain valve 72 for the same reasons as discussed above in reference to drain valve 74.

As fluid is being advanced out of piston chamber 106 in the above described manner, fluid is simultaneously being advanced into rod chamber 108. In particular, fluid is advanced from tank 130 into fluid line 186, through check valve 78, and into fluid line 160 via fluid line 182 and junction 184. Once in fluid line 160, the fluid is advanced into rod chamber 108 via rod port 112.

Therefore, it should be appreciated that having fluid cylinder in the float mode allows rod 26 to freely move outwardly from housing 28 in the direction indicated by arrow 30 or move inwardly into housing 28 in the direction indicated by arrow 32. Allowing rod 26 the above described freedom of movement relative to housing 28 while being isolated from operational pressure source 34 reduces the wear and tear on work machine 10, and in particular reduces the wear and tear on a rotate motor (not shown) which is used to rotate grapple 56 relative to head 54.

However, under certain circumstances fluid cylinder 22 must be taken out of the float mode and placed in the extend mode or the retract mode. For example, when the operator of work machine 10 is attempting to grasp a number of logs 66 with grapple 56 is he or she may have to tilt or rotate work implement 20 relative to stick 18 in order to properly orient grapple 56 relative to logs 66. In particular, as shown in FIG. 1, the operator may have to rotate work implement 20 relative to stick 18 in the direction indicated by arrow 62. To tilt work implement 20 in the aforementioned direction the operator takes work implement actuator 52 out of the float position and places it into the a first tilt position. In particular, the operator places button 82 of joystick 80 in the depressed position while leaving button 86 of joystick 84 in the non-depressed position. Depressing button 82 while leaving button 86 in the non-depressed position places work implement actuator 52 in the first tilt position. In addition, placing work implement actuator in the first tilt position causes current to be applied to a solenoid 212 associated with spool valve 70 via electrical line 150. (Note that although not shown in FIG. 2, buttons 82 and 86 are both electrically coupled to power supply 88.) Applying current to solenoid 212 in the above described manner causes spool valve 70 to move from the rest position to the first spool position. Placing spool valve in the first spool position allows fluid to be advanced from fluid line 142 through spool valve 70 via valve ports 122 and 124. Placing spool valve 70 in the first spool position also allows fluid to be advanced from fluid line 158 through spool valve 70 via valve port 126 and tank port 128. Advancing fluid through valve port 126 and tank port 128 directs the fluid to fluid line 154 which leads back to tank 130. However, advancing the fluid through valve ports 122 and 124 directs the fluid to fluid line 156 which is coupled to control valve 36. Advancing fluid through fluid line 156 causes control valve 36 to move from the neutral position to the extend position.

Placing control valve 36 in the extend position prevents fluid from being advanced through control valve 36 via pilot ports 100 and 102. On the other hand placing control valve 36 in the extend position allows fluid to be advanced from fluid line 134 through control valve 36 via pressure ports 92 and 96. The consequences of preventing fluid flow through pilot ports 100 and 102 will be discussed first.

Preventing the flow of fluid through pilot ports 100 and 102 causes the pressure in pilot line 42 to increase thereby causing the pressure in sensor line 210 to increase. In particular, the pressure in pilot line 42 and sensor line 210 increases so as to reach or exceed the predetermined threshold of pressure sensor 46. Causing the pressure in sensor line 210 to reach or exceed the threshold of pressure sensor 46 results in a switch 214 of pressure sensor 46 moving from an open position to a closed position. (Note that FIG. 2 only shows switch 214 in the open position.) Moving switch 214 from the open position to the closed position causes current to be applied from power source 88 to float relay 90 via electrical line 196. Applying current to float relay 90 via electrical line 196 causes or signals float relay 90 to be placed in the open position. (Note that FIG. 2 only shows float relay 90 in the closed position.) When float relay 90 is located in the open position the solenoid associated with float valve 38 is electrically isolated from power source 88 (i.e. no current is applied to the solenoid). Electrically isolating the solenoid associated with float valve 38 from power source 88 causes float valve 33 to be positioned in the closed position. Positioning float valve 38 in the closed position prevents fluid from being advanced through float valve 38. It should be appreciated that as long as the pressure in sensor line 210 is at or exceeds the threshold of pressure sensor 46, float valve 38 is maintained in the closed position.

Allowing fluid to be advanced from fluid line 134 through control valve 36 via pressure ports 92 and 96 when control valve 36 is in the extend position results in fluid being advanced into fluid line 162. Fluid line 162 then directs the fluid into piston chamber 106 of fluid cylinder 22 via piston port 110. Note that the fluid in fluid line 162 bypasses float valve 38 since float valve 38 is in the closed position as discussed above. Moreover, it should be understood that drain valve 72 and check valve 76 substantially prevent the fluid from being directed to tank 130 during the above described operation. Causing fluid to be advanced into piston chamber 106 in the above described manner results in piston 104, and therefore rod 26, being moved relative to housing 28 in the direction indicated by arrow 30. Moving piston 104 in the aforementioned manner causes fluid to be advanced out of rod chamber 108 via rod port 112 and into fluid line 160. The fluid advanced into fluid line 160 is then directed to tank 130 by a fluid path defined by junction 184, fluid line 182, drain valve 74, and fluid line 186. The fluid advanced into fluid line 160 can also be directed to tank 130 by a fluid path defined by pressure port 94 and drain port 98 of control cylinder 36 and fluid line 190. Note that the fluid being advanced through fluid line 160 also bypasses float valve 38 in the above described mode of operation since float valve 38 is located in the closed position.

Directing fluid in the above described manner and thereby urging rod 26 outwardly from housing 28 results in work implement 20 being rotated or tilted relative to stick 18 in the direction indicated by arrow 62 (see FIG. 1).

Once work implement 20 is positioned in the proper orientation and logs 66 have been grasp by grapple 56 the operator of work machine 10 releases (i.e. stops depressing) button 82 of work implement actuator 52. Once button 82 is released button 82 returns back to the non-depressed position, which in turn returns work implement actuator 52 to the float position. Returning work implement actuator 52 back to the float position prevents current from being applied to solenoid 212 which in turn causes spool valve 70 to be positioned in the rest position. Placing spool valve in the rest position prevents fluid from being advanced to control valve 36 via spool valve 70 and fluid line 156, which in turn results in control valve 36 returning to the neutral position. Once control valve 36 is in the neutral position fluid can one again flow through control valve 36 via pilot ports 100 and 102.

Allowing fluid to flow through pilot ports 100 and 102 causes the pressure in pilot line 42 to decrease, therefore the pressure in sensor line 210 also decreases. In particular, the pressure in sensor line 210 decreases to a point below the threshold of pressure sensor 46. Once the pressure in sensor line 210 is below the threshold of pressure sensor 46, switch 214 of pressure sensor 46 returns to the open position. Having switch 214 in the open position causes (i.e. signals) float relay 90 to return to the closed position, which in turn allows current to be applied to the solenoid associated with float valve 38. Applying a current to the solenoid associated with float valve 38 results in float valve 38 being placed in the open position thereby placing fluid cylinder 22 back in the float mode of operation.

Thus it should be appreciated that apparatus 24 functions to automatically place fluid cylinder 22 back into the float mode of operation as soon as the operator of work machine 10 stops tilting or rotating work implement 20 with work implement actuator 52. This is in contrast to other arrangements which require the operator to actively place a fluid cylinder in and out of the float mode of operation by periodically manipulating a lever of button located in the cab assembly of the work machine. As discussed above, these types of arrangements are inconvenient for the operator, and tend to decrease the time the fluid cylinder is in the float mode. As a result the fluid cylinder is subjected to a greater degree of wear.

The operator of work machine 10 can also place work implement actuator 52 in the second tilt position which causes work implement 20 to rotate relative to stick 18 in the direction indicated by arrow 64 (see FIG. 1). To place work implement actuator 52 in the second tilt position, button 86 of joystick 84 is depressed which causes current to be applied to solenoid 216 via electrical line 152. Applying current to solenoid 152 causes spool valve 70 to move from the rest position to the second spool position. Once in the second spool position, fluid can advance from fluid line 142 through spool valve 70 via pump port 122 and valve port 126. After passing through spool valve 70 the fluid is advanced into fluid line 158 which is coupled to control valve 36. Advancing fluid through fluid line 158 causes control valve 36 to be moved from the neutral position to the retract position. Placing control valve 36 in the retract position prevents fluid from flowing through pilot ports 100 and 102. Preventing fluid from passing through pilot ports 100 and 102 results in float valve 38 being moved from the open position to the closed position and thus takes fluid cylinder 22 out of the float mode of operation as described above.

Placing control valve 36 in the retract position allows fluid to be advanced from fluid line 134 through control valve 36 via pressure ports 92 and 94. Once through control valve 36 the fluid is advanced through fluid line 160 and into rod chamber 108 of fluid valve 22 via rod port 112. Note that the fluid advancing through fluid line 160 bypasses the closed float valve 38. Once advanced into rod chamber 108, the fluid causes rod 26 to move in the direction indicated by arrow 32, which causes work implement to rotate relative to stick 18 in the direction indicated by arrow 64 (see FIG. 1). In a manner similar to that discussed above, drain valve 74 and check valve 78 substantially prevent the fluid from being directed to tank 130 during the above described operation.

Moving piston 104 and rod 26 in the direction of arrow 32 causes fluid to be advanced out of piston chamber 106 via piston port 110 and into fluid line 162. The fluid advanced into fluid line 162 is then directed to tank 130 by a fluid path defined by junction 176, fluid line 174, drain valve 72, and fluid line 178. The fluid advanced into fluid line 162 can also be directed to tank 130 by a fluid path defined by pressure port 96 and drain port 98 of control cylinder 36 and fluid line 190. Note that the fluid being advanced through fluid line 162 also bypasses the closed float valve 38 in the above described mode of operation.

Once the operator of work machine 10 is finished retracting rod 26 into housing 28 he or she releases (i.e. stops depressing) button 86 of work implement actuator 52. Once button 86 is released, button 86 returns back to the non-depressed position, which in turn returns work implement actuator 52 to the float position. Returning work implement actuator 52 back to the float position prevents current from being applied to solenoid 216 which in turn causes spool valve 70 to be positioned in the rest position. Placing spool valve in the rest position prevents fluid from being advanced to control valve 36 via spool valve 70 and fluid line 158, which in turn results in control valve 36 returning to the neutral position. Once control valve 36 is in the neutral position fluid cylinder 22 is automatically returned to the float mode of operation as described above.

It should also be understood that work machine 10 can also be operated when actuation switch 48 is located in the deactuated position. However, operating work machine 10 in the deactuated position prevents fluid cylinder 22 being placed in the float mode of operation.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

What is claimed is:

1. An apparatus for operating a fluid cylinder of a work machine, said fluid cylinder (i) having a rod and a housing and (ii) being operable in (1) an extend mode in which said rod is urged outwardly from said housing by fluid being advanced by an operational pressure source and (2) a retract mode in which said rod is urged inwardly into said housing by fluid being advanced by said operational pressure source, comprising:

a cylinder actuator operatively coupled to said fluid cylinder, said cylinder actuator being positionable between (i) an extend position in which said fluid cylinder is placed in said extend mode, (ii) a retract position in which said fluid cylinder is placed in said retract mode, and (iii) an isolate position in which said fluid cylinder is isolated from said operational pressure source;

a sensing arrangement operatively coupled to said cylinder actuator and said fluid cylinder so that (i) said sensing arrangement detects when said cylinder actuator is in said isolate position and (ii) said sensing arrangement generates a signal in response to detecting that said cylinder actuator is in said isolate position so as to cause said fluid cylinder to be placed in a float mode of operation in which said rod is substantially free to move outwardly from said housing or move inwardly into said housing and;

a control valve operatively coupled to said actuator and said fluid cylinder so that when (i) said cylinder actuator is in said extend position or said retract position fluid is advanced through said control valve by said operational pressure source and (ii) said cylinder actuator is in said isolate position fluid is prevented from being advanced through said control valve by said operational pressure source, wherein said sensing arrangement includes (i) a pilot line fluidly coupled to said control valve, (ii) a pilot pressure source fluidly coupled to said pilot line, and (iii) a pressure sensor fluidly coupled to said pilot line, fluid is allowed to advance out of said pilot line and through said control valve when said cylinder actuator is in said isolate position, fluid is prevented from being advanced out of said pilot line and through said control valve when said cylinder actuator is positioned in said retract position or said extend position so as to cause an increase in pressure in said pilot line, and said pressure sensor detects said increase in pressure of said pilot line an generates a signal in response thereto.

2. The apparatus of claim 1, further comprising:

a float valve operatively coupled to said fluid cylinder, said float valve being positionable between (i) an open position in which fluid being advanced from said fluid cylinder can be advanced through said float valve and (ii) a closed position in which fluid being advanced from said fluid cylinder can not be advanced through said float valve, wherein said float valve is positioned in said open position when said fluid cylinder is in said float mode of operation.

3. The apparatus of claim 1, further comprising:

an actuation switch positionable between an actuated position and a deactuated position, wherein (i) said actuation switch is electrically coupled to said pressure sensor, (ii) said pressure sensor is positionable between an on position and an off position, (iii) placing said actuation switch in said actuated position places said pressure sensor in said on position, and (iv) placing said actuation switch in said deactuated position places said pressure sensor in said off position.

4. The apparatus of claim 1, further comprising:

a pilot manifold interposed between said pilot line and said pilot pressure source.

5. A work machine, comprising:

a work implement;

a fluid cylinder mechanically coupled to said work implement, said fluid cylinder (i) having a rod and a housing and (ii) being operable in (1) an extend mode in which said rod is urged outwardly from said housing and (2) a retract mode in which said rod is urged inwardly into said housing;

an operational pressure source for advancing a fluid so as to cause said rod to be urged outwardly or inwardly relative to said housing;

a control valve (i) positionable between an extend position, a retract position, and a neutral position and (ii) fluidly coupled with said operational pressure source and said fluid cylinder so that when said control valve is (1) in said extend position said fluid cylinder is in said extend mode, (2) in said retract position said fluid cylinder is in said retract mode, and (3) in said neutral mode said fluid cylinder is isolated from said operational pressure source;

a float valve fluidly coupled to said fluid cylinder, said float valve being positionable between (i) an open position in which fluid from said fluid cylinder can be advanced through said float valve and (ii) a closed position in which fluid from said fluid cylinder can not be advanced through said float valve; and a sensing arrangement (i) coupled to said control valve and said float valve and (ii) operable so as to cause said float valve to be (1) positioned in said open position in response to detecting that said control valve is positioned in said neutral position and (2) positioned in said closed position in response to detecting that said control valve is positioned in said extend position or said retract position, wherein said sensing arrangement includes (i) a pilot line fluidly coupled to said control valve, (ii) a pilot pressure source fluidly coupled to said pilot line, and (iii) a pressure sensor fluidly coupled to said pilot line, fluid is allowed to advance out of said pilot line and through said control valve when said control valve is positioned in said neutral position, fluid is prevented from being advanced out of said pilot line and through said control valve when said control valve is positioned in said retract position or said extend position so as to cause an increase in pressure in said pilot line, and said pressure sensor detects said increase in pressure of said pilot line.

6. The apparatus of claim 5, wherein:

said pressure sensor is electrically coupled to said float valve so that when said pressure sensor detects said increase in pressure in said pilot line said float valve moves from said open position to said closed position.

7. The work machine of claim 5, further comprising:

an actuation switch positionable between an actuated position and a deactuated position, wherein (i) said actuation switch is electrically coupled to said pressure sensor, (ii) said pressure sensor is positionable between an on position and an off position, (iii) placing said actuation switch in said actuated position places said pressure sensor in said on position, and (iv) placing said actuation switch in said deactuated position places said pressure sensor in said off position.

8. The work machine of claim 5, further comprising:

a pilot manifold interposed between said pilot line and said pilot pressure source.

9. The work machine of claim 5, wherein:

when said float valve is positioned in said open position said fluid cylinder is placed in a float mode of operation in which said rod of said fluid cylinder is substantially free to move (i) outwardly from said housing or (ii) inwardly into said housing.

10. The work machine of claim 5, further comprising:

a work implement actuator operatively coupled to said control valve, said work implement actuator being positionable between a first tilt position and a second tilt position, wherein positioning said work implement actuator in (i) said first tilt position causes said control valve to be placed in said extend position and (ii) said second tilt position causes said control valve to be placed in said retract position.

11. The work machine of claim 5, wherein:

placing said fluid cylinder in said extend mode causes said work implement to move in a first direction, and placing said fluid cylinder in said retract mode causes said work implement to move in a second direction.

12. The work machine of claim 11, wherein:

said work implement includes a head, a grapple secured to said head, and an outrigger secured to said head.

13. The work machine of claim 5, further comprising:

a track assembly for advancing said work machine over a ground segment.

* * * * *